US006441594B1

(12) United States Patent
Connell et al.

(10) Patent No.: US 6,441,594 B1
(45) Date of Patent: Aug. 27, 2002

(54) LOW POWER VOLTAGE REGULATOR WITH IMPROVED ON-CHIP NOISE ISOLATION

(75) Inventors: Lawrence Edwin Connell, Naperville; Daniel Patrick McCarthy, Elk-Grove Village, both of IL (US)

(73) Assignee: Motorola Inc., Schaumburg, IL (US)

( * ) Notice: Subject to any disclaimer, the term of this patent is extended or adjusted under 35 U.S.C. 154(b) by 0 days.

(21) Appl. No.: 09/845,059

(22) Filed: Apr. 27, 2001

(51) Int. Cl.[7] ..... G05F 1/40
(52) U.S. Cl. ..... 323/274; 323/276
(58) Field of Search ..... 323/225, 226, 323/273, 274, 275, 276, 277, 279, 280, 281

(56) References Cited

U.S. PATENT DOCUMENTS

| | | | | | |
|---|---|---|---|---|---|
| 3,939,399 | A | * | 2/1976 | Funatsu et al. | 323/275 |
| 4,366,432 | A | | 12/1982 | Noro | 323/225 X |
| 5,260,644 | A | | 11/1993 | Curtis | 323/226 |
| 5,666,044 | A | * | 9/1997 | Tuozzolo | 323/277 |
| 6,016,245 | A | * | 1/2000 | Ross | 323/276 X |

* cited by examiner

*Primary Examiner*—Jessica Han
(74) *Attorney, Agent, or Firm*—Heather L. Mansfield; Joanne N. Pappas

(57) ABSTRACT

A voltage regulator 100, 130 for isolating radio frequency circuits from on chip digital circuit originated noise and an integrated circuit chip including the voltage regulator. The voltage regulator 100, 130 includes regulator device (a PFET) 106 driven by a sense amplifier 110 to derive a regulator voltage 108 from a supply voltage 102. Another sense amplifier 114 senses changes in output load and adjusts current flow through a current shunt 120, 122 so that the current shunt 120, 122 shunts excess load current. The sense amplifier 110 driving the voltage regulator device 106 senses current flow through the current shunt 120, 122 and adjusts the current supplied by the regulator device 106 to reduce excess current. The current shunt 120, 122 is a series connected PFET 120 and NFET diode 122, with the gate of the PFET 120 driven to control current flow. Each of the sense amplifiers 110, 114 includes a pair of PFETs 132, 134 140, 142 and a pair of NFETs 136, 138 144, 146, the drain of each PFET of the pair is tied to a corresponding drain of one of the pair of NFETs. A voltage divider 116, 118 connected between the regulator voltage 108 and ground provides a sense voltage to the output sense amplifier 114 so that the output sense amplifier compares the sense voltage against a reference voltage (VREF) to determine whether the regulator device is providing too much, not enough or just the right output current level.

20 Claims, 2 Drawing Sheets

130

LOW POWER VOLTAGE REGULATOR WITH IMPROVED ON-CHIP NOISE ISOLATION

BACKGROUND OF THE INVENTION

1. Field of the Invention

The present invention is related to power supply regulators for radio frequency applications and more particularly to a shunt regulator for high frequency applications.

2. Background Description

Voltage regulators are well known. An ideal voltage regulator provides a constant voltage regardless of load. Thus, the voltage regulator provides the same voltage under no load (at no current) as it does fully loaded. Current used by circuits in the complementary insulated gate field effect transistor (FET) technology, commonly known as CMOS, primarily, is switching current with negligible static (or DC) current flow.

CMOS circuit current flow usually occurs only during switching, primarily, either to charge or discharge the circuit's load (capacitance). Thus, digital circuits that are synchronized by a common clock signal may exhibit sporadic episodes of very high switching current, e.g., from a counter switching from $FFFF_{16}$ to $OOOO_{16}$. By contrast, typical radio frequency circuits, such as may be used in a radio telephone or cellular phone, exhibit relatively uniform switching and, therefore, have relatively uniform current. Variations between no load and full load current, such as may occur with digital circuits, can cause large switching noise that must be filtered to prevent errors in CMOS analog circuits on the same integrated circuit substrate or chip. Shunt regulators may be used to reduce switching and other current related noise.

A typical shunt regulator includes an alternate current path for regulator current, the regulator supplying constant current during no load conditions as well as during full load. The parallel current path maintains an effective load such that even as the load varies, the regulator supplies constant (full load) current with excess current being shunted through the parallel path. Many state of the art shunt regulators are designed to maintain effective constant current. That unused portion of the full load current in excess of the load current is shunted through a shunt device in the shunt regulator and so, wasted.

High frequency circuits, and especially radio frequency (RF) circuits, are very sensitive to noise. Switching noise from digital circuits can easily couple into radio frequency circuits thereby, degrading circuit performance. As higher degrees of integration are being achieved, larger numbers of complex high frequency circuits are being integrated onto a single integrated circuit chip. Further, as digital circuit performance improves, digital functions are also being combined with RF functions onto monolithic integrated circuit chips integrating more and more digital and RF circuits onto the same chip and resulting in an increased number of local potential noise sources on a given chip. To mitigate this problem on-chip voltage regulators may be used to provide separate isolated voltage supplies for digital and for RF circuits, thereby, isolating digital switching currents from input power supplies and from other on-chip RF circuits. This approach significantly reduces the digital switching noise that might otherwise couple into the RF circuits. Typically, shunt regulators are used for this type of isolation.

A typical prior art shunt regulator is described in U.S. Pat. No. 4,366,432 entitled "Highly Stable Constant-Voltage Power Source Device" to Noro. Noro describes a shunt regulator that is biased to deliver a constant current to a parallel combination of a load and shunt device. This constant current value must be set high enough to supply the maximum load current and any lesser variations thereof with the excess passing through the shunt device. Consequently, Noro's shunt regulator constantly provides the maximum current and, when there is no load current, i.e., it is unloaded, all of the supply current is shunted through the shunt device. Accordingly, when the load is less than full, Noro wastes some of the power supplied.

U.S. Pat. No. 5,260,644 entitled "Self-Adjusting Shunt Regulator and Method" to Curtis describes a shunt regulator which attempts to isolate power supply and load, automatically adjusting supply current to compensate for load variations. Unfortunately, the Curtis shunt regulator also consume & excess power when it is not fully loaded. The Curtis shunt regulator varies shunt current to compensate for changes in load currents such that fluctuation of total supply current are only a small fraction of fluctuations of load current.

These prior art shunt regulators are used to provide isolation between a chip power supply and a digital circuit portion of the chip load. These shunt regulators can tolerate rapidly varying load current. Unfortunately, these typical prior art shunt regulators suffer from excessive power consumption, while only providing limited isolation between digital and RF circuits that are integrated onto the same integrated circuit chip.

Thus, there is a need for improved shunt regulators that more effectively isolate digital circuits from RF circuits integrated onto the same chip, but with a minimum increase in load current.

BRIEF DESCRIPTION OF THE DRAWINGS

The foregoing and other objects, aspects and advantages will be better understood from the following detailed preferred embodiment description with reference to the drawings, in which.

DETAILED DESCRIPTION OF A PREFERRED EMBODIMENT OF THE INVENTION

The present invention is a voltage regulator, which may be termed a shunt regulator, for isolating radio frequency circuits from on-chip digital circuit originated noise and the integrated circuit chip. Unlike prior art shunt regulators, which constantly supply full current, shunting any current not used by the load; the voltage regulator of the present invention constantly shunts a minimum current, e.g., 1 mA, and supplies whatever current needed for the load in excess of that minimum, responsive to variations in the shunt current. The voltage regulator includes regulator device (a PFET) driven by a sense amplifier to derive a regulator voltage from a supply voltage. Another sense amplifier senses changes in output voltage resulting from load current changes and adjusts current through a current shunt so that the current shunt shunts excess load current. The sense amplifier driving the regulator device senses current flow through the current shunt and adjusts the current supplied by the regulator device, to reduce excess current. The current shunt is a series connected PFET and NFET diode with the gate of the PFET driven to control current flow. Each of the sense amplifiers includes a pair of PFETs and a pair of NFETS, the drain of each PFET of the pair is tied to a corresponding drain of one of the pair of NFETs. A voltage divider connected between the regulator voltage and ground provides a sense voltage to the output sense amplifier so that the output sense amplifier compares the sense voltage against a reference voltage to determine whether the current shunt is providing too much, not enough or just the right output voltage level.

Figure 1:
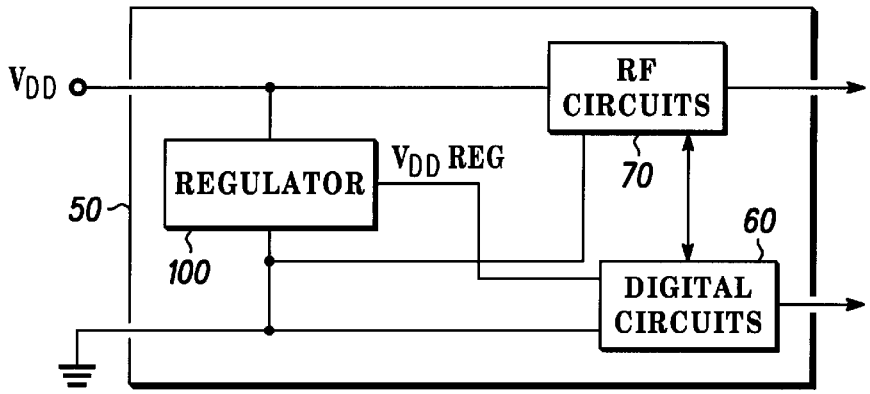
FIG. 1 shows an example of a preferred embodiment integrated circuit chip with both digital and RF circuits.
Figure 2:
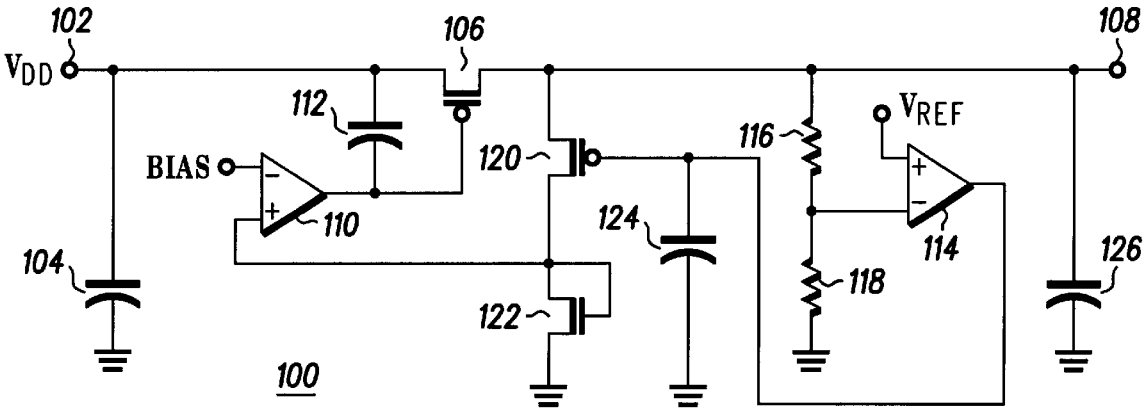
FIGS. 2 and 3 show a block diagram of the preferred embodiment voltage regulator according to the present invention.

Turning now to the drawings and more particularly FIG. 1 shows an example of an integrated chip 50 with both digital circuits 60 and radio frequency circuits 70 isolated by voltage regulator 100 with constant shunt current according to the preferred embodiment of the present invention. FIG. 2 shows a block diagram of the voltage regulator 100 according to the preferred embodiment of the present invention. The present invention is a low power, high performance voltage regulator 100 that senses and compensates for load variations reflected in a minimum shunt current, e.g., one milliamp (1 mA), supplying load current as needed, thereby maintaining unneeded shunt current at an efficiently low level, while providing improved voltage regulation to connected circuits. Experimentally, a 12 dB supply noise reduction has been shown using the shunt regulator circuit 100 for improved on-chip isolation between noisy digital circuits and sensitive high performance analog circuits integrated on the same chip.

In FIG. 2, chip supply voltage (VDD) is applied to the voltage regulator 100 at supply line 102. An input decoupling capacitor 104 is connected between VDD (or VDD) 102 and ground (GND). The source of a voltage regulation device, PFET 106, is connected to the unregulated input or supply voltage 102. The drain of PFET 106 is connected to provide output regulated voltage 108, isolating VDD from regulated supply voltage VDDREG. Sense amplifier 110 drives the gate of regulator PFET 106 with frequency compensation capacitor 112 connected between the output of sense amplifier 110 and unregulated supply voltage VDD 102. The negative input to sense amplifier 110 is connected to a bias voltage $V_{BIAS}$ and its positive input is connected to a current sense device in the output of the shunt regulator 100. Resistors $R_1$, 116 and $R_2$, 118 are connected between the regulated output voltage 108 and ground to form a voltage divider. A reference voltage (VREF) is provided to the positive input of a voltage sensing sense amplifier 114 and a sense voltage from voltage divider resistors 116, 118 provides its negative input. The output of sense amplifier 114 biases the gate of shunt PFET 120. The drain of PFET 120 is connected to the gate to drain connection of diode connected NFET diode 122. The source of diode connected NFET 122 is connected to ground. Frequency compensation capacitor 124 is connected between the output of sense amplifier 114 and ground. The drain connection of NFET 122 and PFET 120 is the current sense output, connected to the positive input of sense amplifier 110. Output decoupling capacitor 126 is connected between regulated output voltage VDDREG 108 and ground.

Figure 3:
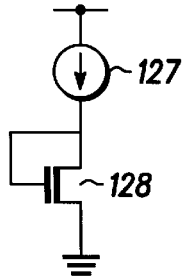

FIG. 3 is an example of a bias voltage ($V_{BIAS}$) generator. A bias reference current ($I_{bias}$) source 127 is connected to the gate/drain of a diode connected NFET 128. The source of NFET 128 is connected to ground. The bias voltage ($V_{BIAS}$) is the gate to source voltage of NFET 128 and is representative of bias reference current $I_{BIAS}$.

At steady state, VDDREG =VREF *(R1+R2)/R2. The output of sense amplifier 114 is equal to VDDREG less the magnitude of the PFET threshold voltage ($V_{Tp}$) and some small voltage ($*_p$), i.e., VDDREG−*$V_{TP}$*−*p. PFET 120, the gate of which is driven by sense amplifier 114, is controlled to shunt excess current at the output of shunt regulator 100, thereby maintaining a steady state regulator output voltage of VDDREG. The current shunted by PFET 120 passes through diode connected NFET 122, driving NFET 122 to a voltage ($V_{SHUNT}$) representative of the shunt current and approximately equal to $V_{BIAS}$. The voltage developed across NFET 122 is applied to the positive input of sense amplifier 110. $V_{BIAS}$ is applied to the negative input of current sense amplifier 110 and may be generated as described hereinabove for FIG. 3. To provide adequate frequency stability of the shunt current feedback control loop, the shunt current from PFET 120 is nominally driven to a current level of about 1 mA. Innput decoupling capacitor 104 is charged to VDD and output capacitor 126 is charged to VDDREG. Capacitors 112 and 124 are charged appropriately.

Sense amplifier 110 compares voltages $V_{SHUNT}$ and $V_{BIAS}$ to effectively compare reference current $I_{ref}$ to the current shunted by PFET 120. Optimally, PFET 106 is driven just enough to pass sufficient current that regulated output voltage VDDREG maintains its desired output voltage level, while simultaneously maintaining the shunt current of PFET 120 to a constant current level and proportional to the reference current $I_{ref}$. Thus, if load current is zero (0), current through PFET 106 is 1 mA, i.e., the shunt current. If, on the other hand, load current is 10 mA, for example, current supplied through PFET 106 is 11 mA, i.e., load current plus shunt current. In this way power consumption is minimized.

Figure 4:
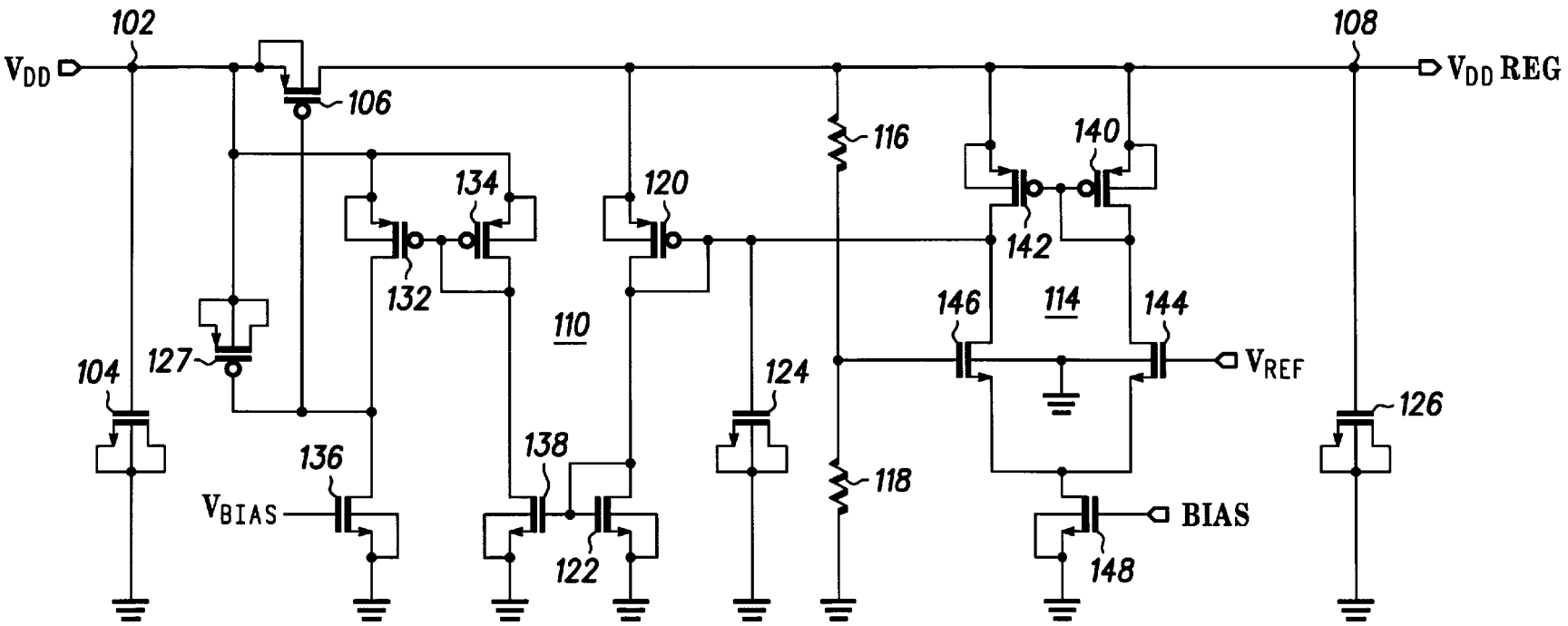
FIG. 4 shows a schematic of an implementation of the voltage regulator of FIGS. 2 and 3.

FIG. 4 shows a schematic of voltage regulator 130, which is a CMOS circuit implementation of the shunt regulator 100 of FIG. 2. Devices in FIG. 4 having identical functions as those of FIG. 2 are labeled identically. Sense amplifier 110, which includes current mirror PFET pair 132, 134 and NFET pair 136, 138, is connected between unregulated voltage supply line 102, VDD, and ground. The gates of PFET pair 132, 134 are tied together and, to the drain of PFET diode 134, which is also connected to the drain of NFET 138. The source of both PFETs of pair 132, 134 are connected to unregulated supply voltage 102. The drain of PFET 132 is connected to the drain of NFET 136 and, as the output of sense amplifier 110, also is connected to the gate of pass device 106 and a plate of capacitor 112, which in this example is the gate of a PFET capacitor. The other plate of PFET capacitor 112 (the source/drain of the PFET) is connected to unregulated supply voltage 102. $V_{BIAS}$ is provided to the gate of NFET 136. The input to sense amplifier 110 at the gate of NFET 138 is connected to the anode (i.e. gate drain) of current mirror diode connected device, NFET 122, and to the drain of PFET 120. The source of PFET 120 is connected to regulated voltage 108, VDDREG.

The gate of PFET 120 is connected to the output of sense amplifier 114 and the plate of capacitor 124, which in this example is the gate of an NFET capacitor. Sense amplifier 114 includes PFET pair 140, 142, NFET pair 144, 146 and current bias NFET 114. PFET diode 140 and PFET 142 are a current mirror pair with their gates being tied together and to the drain of diode PFET 140. The drain of NFET 144 is connected to the drain of current mirror device PFET 140. The drain of PFET 142 is connected to the drain of NFET 146. The gate of PFET 120 and capacitor 124, which in this example is an NFET capacitor, are connected to the output of sense amplifier 114 at the drain of the PFET 142 and the drain of NFET 146. The source of NFET pair 144 and 146 are connected together in common and that ommon connection is connected to the drain of NFET 148. The source of NFET 148 is connected to ground. Reference voltage ($V_{REF}$) is provided to positive input of sense amplifier 114 at the gate of NFET 144 and $V_{BIAS}$ is provided to the gate of NFET 148. The negative input of sense amplifier 114 at the gate of NFET 146 is connected between voltage divider resistors 116, 118. Output decoupling capacitor 126, in this example an NFET capacitor, is connected between VDDREG 108 and ground.

Accordingly, the shunt regulator circuit 100, 130 controls and maintains minimum excess current through the regulating shunt device, PFET 120, and provides improved isolation from a digital switching load circuit at regulated voltage output 108. Further, power consumption as well as wasted power is minimized. Current through shunt device 120, i.e., that which is not provided to load, passes through the PFET 120 to diode NFET 122. NFFT 122 exhibits a voltage proportional to current flow at the input to sense amplifier 110. Sense amplifier 110 reacts to voltage changes across NFET 122, sensing the change of current through load device 120. So, any current change through NFET 122 causes a proportionate change in voltage ($V_{DS}$) across NFET 122, which is provided to the input of sense amplifier 110, i.e., gate of NFET 138. NFET 138 mirrors current through NFET diode 122. The same current through NFET 138 passes through PFET diode 134. A corresponding voltage develops across PFET 134 to bias the gate of PFET 132. Therefore, the current through PFET diode 134 is mirrored in PFET 132. NFET 136 is biased with bias voltage $V_{BIAS}$, such that variation in current through it ($I_{DS}$) is reflected as a proportionate change in its drain to source voltage, $V_{DS}$ Thus, the change in $I_{DS}$ for NFET 136 changes device drain to source voltage $V_{DS}$, (which is the voltage at the gate of regulator device PFET 106), thereby, adjusting the current passed through PFET 106. PFET frequency compensation capacitor 112 frequency compensates sense amplifier 110 and also filters instantaneous changes in the drain voltage of NFET 136 to eliminate any noise that might otherwise be imposed across the gate to source terminals of PFET 106, and, so, passed to the regulated output 108. The change in gate voltage of PFET 106 compensates for instantaneous load variations in such a way that instantaneous current changes through PFET 120 do not change regulated output voltage VDDREG. Consequently, most current provided by PFET 106 passes only to a connected load, and only a minor constant current is shunted through the shunt device 120 and so, very little current is wasted.

Thus, if the output load 108 increases sufficiently to drop the output voltage VDDREG 108, the voltage at the negative input to second sense amplifier 114 is reduced proportionately through the voltage divider 116, 118. This reduced divider voltage reduces the current flow through NFET 146 at the negative input of second sense amplifier 114. Reduced current flow through NFBT 146 allows PPET 142 to pull the gate of PFET 120 slightly higher, reducing the drive on PFET 120 and, correspondingly, current therethrough, i.e. $I_{SD}$. Reduced $I_{SD}$ through PFET 120 causes correspondingly reduced ISD through NFET 122. Reduced current through NFET diode 122 reduces the voltage across NFET 122, $V_{DS}$, thereby reducing the drive on device 138. Reduced drive on NFET device 138 reduces the current through NFET 138 and, correspondingly, through PFET 134. Reduced current flow through PFET 134 reduces the drain to source voltage across PFET 134, $V_{SD}$, thereby, reducing the drive to PFET 132. Reducing the drive to PFET 132 reduces the $I_{SD}$ current through PFET 132 and, correspondingly, reduces the drain to source voltage, $V_{DS}$, of NFET 136. As the drain to source voltage of NFET 136 falls, the gate voltage on PFET 106 is pulled lower, turning PFET 106 on slightly harder, thereby, applying more regulator current to pull the regulated output 108 back up to the desired regulated voltage level. By contrast, if the regulated output voltage rises, the gate of regulator PFET 106 is driven slightly higher, reducing the drive to regulator PFET 106, thereby, reducing output current and adjusting the regulated output voltage down, slightly, to the desired regulator voltage level.

Advantageously, the majority of the current provided by PFET 106 is supplied to any attached load with only a small portion of the supplied current being wasted through the shunt. Whenever a load current fluctuation occurs, the current supplied by PFET 106 is adjusted to compensate for the change in load current. Additional decoupling is provided by output decoupling capacitor 126 which shunts any noise at regulator PFET 106 that might otherwise be passed back to the supply voltage VDD. Also, input decoupling capacitor 104 significantly attenuates any instantaneous high frequency voltage noise that might otherwise pass through PFET 106 to the chip supply VDD. Further, current through the substrate connection exhibits less fluctuation, which in turn reduces substrate noise level.

While the invention has been described in terms of preferred embodiments, those skilled in the art will recognize that the invention can be practiced with modification within the spirit and scope of the appended claims.

We claim:

1. A voltage regulator comprising:

a regulator device deriving a regulator voltage from a supply voltage;

a first sense amplifier sensing a regulator voltage change;

a current shunt shunting excess load current responsive to said first sense amplifier; and a second sense amplifier driving said regulator device responsive to current shunted through said current shunt.

2. A voltage regulator as in claim 1 wherein said current shunt comprises a device of a first conduction type connected in series with a device of a second conduction type.

3. A voltage regulator as in claim 2 wherein the regulator device is a device of said second conduction type.

4. A voltage regulator as in claim 3 wherein said devices are field effect transistors (FETs), said first conduction type is N-type, said second conduction type is P type and said NFET is tied gate to drain.

5. A voltage regulator as in claim 4 wherein the output of said first sense amplifier drives the gate of said current shunt PFET.

6. A voltage regulator as in claim 5 wherein the output of said second sense amplifier drives the gate of said regulator PFET.

7. A voltage regulator as in claim 6 wherein said first sense amplifier and said second sense amplifier each comprises:

a pair of PFETs; and a pair of NFETs, the drain of each of said pair of PFETs being tied to a corresponding drain of one of said pair of NFETs.

8. A voltage regulator as in claim 7 wherein one of said pair of PFETs is tied gate to drain.

9. A voltage regulator as in claim 8 wherein said first sense amplifier further comprises:

a current biasing device, the drain of said current biasing device being tied to the source of each of said pair of NFETs.

10. A voltage regulator as in claim 6 further comprising:

a voltage divider connected between said regulator voltage and a first reference voltage, said voltage divider providing a sense voltage to said first sense amplifier, said first sense amplifier comparing said sense voltage against a second reference voltage.

11. A voltage regulator for isolating radio frequency circuits from on-chip digital circuit switching noise, said shunt regulator comprising:

a regulator device of a first conduction type connected between a regulator voltage and a supply voltage;

a voltage divider connected between said regulator voltage and a first reference voltage and providing a sense voltage;

a first sense amplifier sensing a change in said sense voltage;

a current shunt controlled by said first sense amplifier and shunting excess load current; and a second sense amplifier receiving a voltage representative of shunted current and providing therefrom an output to a control terminal of said regulator device.

12. A voltage regulator as in claim 11 wherein said current shunt comprises a device of said first conduction type connected in series with a device of a second conduction type.

13. A voltage regulator as in claim 12 wherein said devices are field effect transistors (FETs), said first conduction type is P-type, said second conduction type is N-type, said NFET is tied gate to drain, wherein the output of said first sense amplifier drives the gate of said current shunt PFET, and wherein the output of said second sense amplifier drives the gate of said regulator PFET.

14. A voltage regulator as in claim 13 wherein the said first sense amplifier and said second sense amplifier each comprises:

a pair of PFETs, the gate of both of said pair of PFETs being tied to the drain of one of said pair; and a pair of NFETs, the drain of each of said pair of PFETs being tied to a corresponding drain of one of said pair of NFETs.

15. A voltage regulator as in claim 14 wherein said first sense amplifier further comprises:

a current biasing NFET, the drain of said current biasing NFET being tied to the source of each of said pair of NFETs.

16. An integrated circuit chip including both digital circuits and radio frequency communication circuits, a shunt regulator isolating radio frequency circuits from on-chip digital circuit switching noise, said shunt regulator comprising:

a regulator device of a first conduction type connected between a regulator voltage and a supply voltage;

a voltage divider connected between said regulator voltage and a first reference voltage and providing a sense voltage;

a first sense amplifier sensing a change in said sense voltage;

a current shunt controlled by said first sense amplifier and shunting excess load current; and a second sense amplifier receiving a voltage representative of shunted current and providing therefrom an output to a control terminal of said regulator device.

17. An integrated circuit chip as in claim 16 wherein said current shunt comprises a device of said first conduction type connected in series with a device of a second conduction type.

18. An integrated circuit chip as in claim 17 wherein said devices are field effect transistors (FETs), said first conduction type is P-type, said second conduction type is N-type, said NFET is tied gate to drain, wherein the output of said first sense amplifier drives the gate of said current shunt PFET, and wherein the output of said second sense amplifier drives the gate of said regulator PFET.

19. An integrated circuit chip as in claim 18 wherein the said first sense amplifier and said second sense amplifier each comprises:

a pair of PFETs, the gate of both of said pair of PFETs being tied to the drain of one of said pair; and a pair of NFETs, the drain of each of said pair of PFETs being tied to a corresponding drain of one of said pair of NFETs.

20. An integrated circuit chip as in claim 19 wherein said first sense amplifier further comprises:

a current biasing NFET, the drain of said current biasing NFET being tied to the source of each of said pair of NFETs.

* * * * *